United States Patent [19]

Bejean et al.

[11] Patent Number: 5,011,179

[45] Date of Patent: Apr. 30, 1991

[54] LATERAL GUIDE APPARATUS FOR CROSS-COUNTRY SKI, SKI SHOE OPERABLE THEREWITH, AND IMPROVED SKI-COUNTRY SKI

[75] Inventors: Alain Bejean, La Clusaz; Gerard Graillat, Annecy, both of France

[73] Assignee: Salomon S.A., Annecy Cedex, France

[21] Appl. No.: 513,023

[22] Filed: Apr. 25, 1990

Related U.S. Application Data

[63] Continuation of Ser. No. 246,791, Sep. 20, 1988, abandoned.

[30] Foreign Application Priority Data

Nov. 18, 1987 [FR] France ..... 87 15951

[51] Int. Cl.[5] ..... A63C 5/04

[52] U.S. Cl. ..... 280/615; 280/607; 280/636

[58] Field of Search ..... 280/615, 614, 634, 636, 280/618, 620

[56] References Cited

U.S. PATENT DOCUMENTS

| | | | |
|---|---|---|---|
| 2,950,118 | 8/1960 | Sharpe | 280/611 |
| 3,944,238 | 3/1976 | Weigel et al. | 280/636 |
| 4,176,856 | 12/1979 | Glaser | 280/636 |
| 4,335,531 | 6/1982 | Salomon | 280/615 |
| 4,353,576 | 10/1982 | Salomon | 280/615 |
| 4,487,427 | 12/1984 | Salomon | 280/615 |
| 4,801,154 | 1/1989 | Dunand | 280/615 |
| 4,842,293 | 7/1989 | Rochard | 280/615 |

FOREIGN PATENT DOCUMENTS

| | | | |
|---|---|---|---|
| 0152017 | 8/1985 | European Pat. Off. | 280/615 |
| 2058936 | 6/1972 | Fed. Rep. of Germany | 280/615 |
| 3538427 | 5/1986 | Fed. Rep. of Germany | 280/615 |
| 2338719 | 8/1977 | France | 280/615 |
| 2565116 | 12/1985 | France | 280/615 |
| 157845 | 2/1988 | Norway . | |
| 158784 | 7/1988 | Norway . | |

*Primary Examiner*—David M. Mitchell

*Attorney, Agent, or Firm*—Sandler, Greenblum & Bernstein

[57] ABSTRACT

Apparatus for a cross-country ski having a longitudinal median plane for laterally guiding a ski shoe whose toe is attached to the ski on top of the ski and whose heel is vertically movable in the median plane on the ski includes a longitudinally extending guide rib adapted to be attached to the top of the ski. This rib is symmetrically located with respect to the median plane of the ski and has top and lateral side surfaces adapted to cooperate with a longitudinal groove in the sole of the ski shoe. The groove has a bottom and lateral side surfaces for receiving the rib when the sole of the shoe seats on the top of the ski. Finally, a resilient member is interposed between the bottom of the groove in the shoe and the top of the ski for resilient compression in response to the seating of the sole on the top of the ski.

15 Claims, 2 Drawing Sheets

LATERAL GUIDE APPARATUS FOR CROSS-COUNTRY SKI, SKI SHOE OPERABLE THEREWITH, AND IMPROVED SKI-COUNTRY SKI

This application is a continuation of application Ser. No. 07/246,791, filed Sept. 20, 1988 now abandoned.

BACKGROUND OF THE INVENTION

1. Field of the Invention

This invention relates to lateral guide apparatus for a cross-country ski, to a ski shoe cooperable therewith, and to a cross-country ski.

2. Related Subject Matter

Copending application Ser. No. 271,515 filed Nov. 15, 1988, now abandoned, owned by the assignee of the present application discloses related subject matter.

3. Description of Background and Relevant Information

Apparatus for controlling the lateral displacement of a ski shoe whose toe is connected to a cross-country ski generally comprises a longitudinal guide rib mounted on or integral with the upper surface of the ski. In general, the rib has a right trapezoidal cross-section, which is to say, that the rib is defined by an upper horizontal surface and two lateral side surfaces that are inclined with respect to the longitudinal median plane of the ski. A rib of this design contributes to the lateral guidance of a shoe whose toe is connected to the cross-country ski because the sole of the shoe is provided with a longitudinal groove of a shape complementary to the shape of the rib. As the heel of the ski shoe is lowered into engagement with the ski so that the sole of the shoe seats on the top of the ski, the groove in the sole progressively engages the lateral guide rib which thus controls lateral displacement of the shoe and maintains the shoe well centered on the ski.

It is an object of the present invention to provide new and improved apparatus for a cross-country ski which imparts an elastic rebound to the shoe in response to downward movement of the heel into engagement with the ski.

SUMMARY OF THE INVENTION

Apparatus in accordance with the present invention for a cross-country ski having a longitudinal median plane for laterally guiding a ski shoe whose toe is attached to the ski and whose heel is vertically movable in said plane on the ski includes a longitudinally extending guide rib adapted to be attached to the top of the ski symmetrically with respect to the median plane. The guide rib has top and lateral side surfaces adapted to cooperate with a longitudinal groove in the sole of the ski shoe. The groove in the sole has a bottom and lateral side surfaces for receiving the rib when the sole of the shoe seats on the top of the ski. According to the present invention, resilient means are interposed between the bottom of the groove in said shoe and the top of the ski for resilient compression in response to the seating of the sole on the top of the ski.

In one embodiment of the invention, the longitudinal guide rib is of resilient material and thus constitutes the resilient means. In this case, the top of the rib is a distance h from the top of the ski at a given longitudinal position on the ski, and the groove in the sole of the shoe has a depth p at the same longitudinal position, the arrangement being that h is greater than p. In this embodiment, the resilient rib is compressed when the sole of the shoe seats on the top of the ski; and compression of the rib is accompanied by lateral expansion of the rib whose lateral surfaces may engage the sides of the groove. Preferably, the rib is shaped like an isosceles trapezoid and the groove has a complementary shape.

In another embodiment of the invention, the resilient means is separate from, but attached to, the rib which is essentially rigid. In this case, the top of the resilient element is a distance h from the top of the ski at a given longitudinal position on the ski, and the groove has a depth p at the same longitudinal position, the arrangement in this embodiment being that h is greater than p.

In a further embodiment of the invention, the resilient means is separate from the rib and is attached to the bottom of the groove. In this embodiment, the element has a thickness e, and the top of the rib, which is essentially rigid, is a distance h from the top of the ski at a given longitudinal position on the ski while the groove at this longitudinal position has a depth p. In this embodiment, the arrangement is such that h+e is greater than p.

BRIEF DESCRIPTION OF THE DRAWINGS

Non-limiting examples of various embodiments of the present invention are described below with reference to the accompanying drawings wherein.

DESCRIPTION OF PREFERRED EMBODIMENTS

Figure 1:
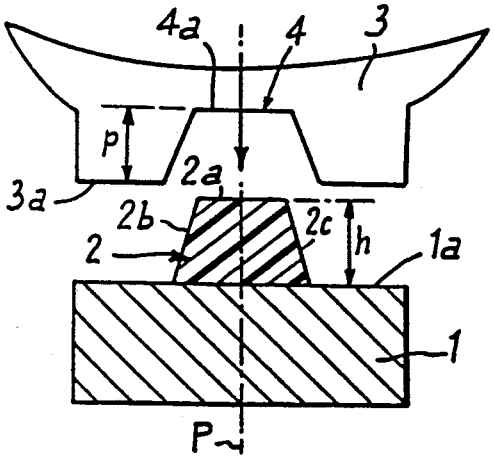
FIG. 1 is a transverse cross-section of a cross-country ski having a longitudinal guide rib that is totally elastic, and showing a shoe separate from the rib in the course of the seating of the sole of the shoe on the top of the ski.
Figure 2:
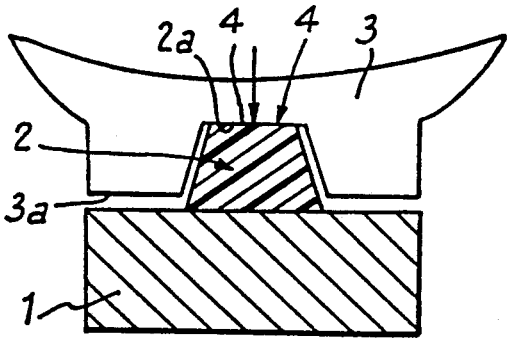
FIGS. 2 and 3 are transverse cross-sections of the cross-country ski of FIG. 1 illustrating the action of the sole of the shoe and the longitudinal guide rib when the shoe is seated on the ski.
Figure 3:
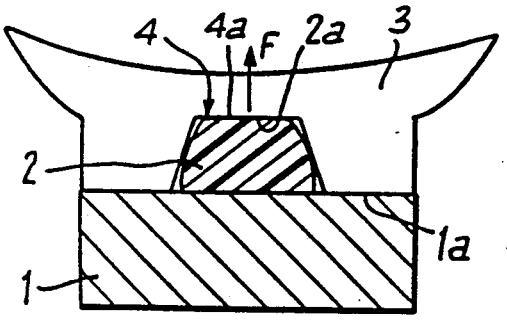

Referring now to the drawings, reference numeral 1 in FIGS. 1–3 designates a cross-country ski whose upper surface 1*a* carries longitudinal guide rib 2 of height h having a transverse cross-section in the form of an isosceles trapezoid. This cross-section is illustrative only, and is not limiting because the cross-section could be any other appropriate shape, and in particular could be a polygonal or curved.

Guide rib 2 is defined by horizontal upper surface 2*a*, and two lateral surfaces 2*b*, 2*c* which preferably are symmetrically located, and inclined downwardly, with respect to longitudinal median plane of symmetry P of the ski. Rib 2 cooperates, during cross-country skiing, with sole 3 of a ski boot whose sole 3 contains on its lower surface longitudinal groove 4 of depth p slightly greater than height h of rib 2. The cross-section of groove 4 is also trapezoidal, and corresponds substantially to that of rib 2. Groove 4 thus closely fits over lateral guide rib 2 when the sole of the shoe seats flat on the ski.

According to the invention, an elastic element is interposed between bottom 4*a* of groove 4 and upper surface 1*a* of ski 1. In the embodiments shown in FIGS. 1–3, the elastic element is constituted by longitudinal guide rib 2 itself which is formed entirely from elastic material, for example rubber. As the sole of the shoe is lowered toward a position flat on the ski, the bottom 4*a* of groove 4 in the sole initially engages upper horizontal surface 2*a* of rib 2 because the depth p of this groove is slightly less than the height h of the rib (See FIG. 2). Subsequently, final movement of sole 3 towards the ski until lower surface 3*a* of the sole engages upper surface 1*a* of the ski elastically compresses rib 2 (see FIG. 3). The compression of the rib is accompanied by its lateral expansion until the sides of the rib engage the sides of the groove.

As a result of its compression, rib 2 forms a spring which exerts an upwardly directed force F (FIG. 3) on bottom 4*a* of groove 4. Thus, in response to the seating of surface 3*a* of sole 3 on top surface 1*a* of the ski, an upwardly directly force F is created by the compression of the rib; and this force contributes to the raising of the heel of the shoe after the sole seats on the ski. In other words, the compression of the rib in response to downward movement of the heel into engagement with the ski imparts an upward rebound on the shoe.

Figure 4:
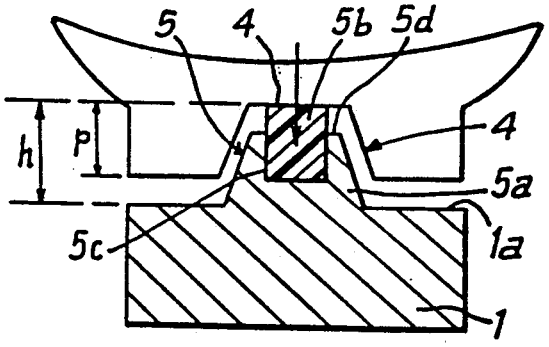
FIGS. 4–8 are vertical and transverse cross-sections of alternative embodiments of the invention.

In an alternative embodiment shown in FIG. 4, cross-country ski 1 includes longitudinal guide rib 5 formed in two portions, namely lower portion 5*a* and upper portion 5*b*. Lower portion 5*a* is relatively rigid and has a transverse cross-section in the form of a trapezoid. Preferably, although not necessarily, portion 5*a* is integral with the ski. Upper portion 5*b* is made of elastic material, which preferably is in the form of a parallelopiped bar embedded in longitudinal groove 5*c* in upper surface 5*d* of lower portion 5*a*. The top free edge of portion 5*b* projects somewhat above upper surface 5*d* of the rib to permit elastic compression when engaged by bottom 4*a* of groove 4 of sole 3. The total height of rib 5, i.e., the height h between the upper surface of elastic bar 5*b* and upper surface 1*a* of ski, 1 is greater than the depth p of groove 4 so as to allow for the compression of the elastic bar during seating of the sole of the shoe on the ski.

Figure 5:
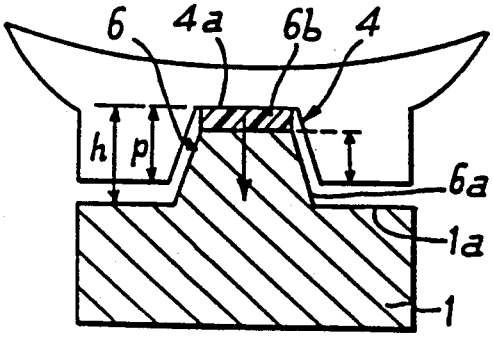

In the alternative embodiment of the invention as shown in FIG. 5, longitudinal guide rib 6 comprises lower portion 6*a* having a transverse cross-section in the form of a trapezoid. Portion 6*a* is made of rigid material and may be integral with ski 1, or attached thereto. Layer 6*b* of elastic material bonded to the upper surface of portion 6*a*. The width of layer 6*b* is the same as the width of the top of portion 6*a* of rib 6. As in the previous embodiments, the total height h of the two portions 6*a*, 6*b* of rib 6 is greater than the depth p of groove 4 of the sole.

Figure 6:
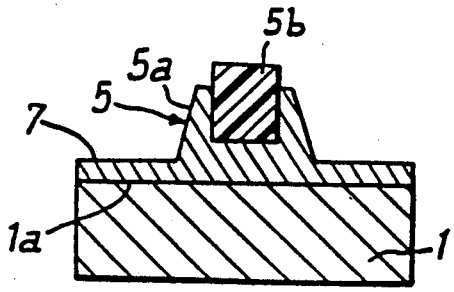

In the alternative embodiment of the invention shown in FIG. 6, longitudinal guide rib 5 is constituted by lower portion 5*a* of rigid material as in the case of the embodiment shown in FIG. 4. That is to say, portion 5*a* in FIG. 6 is trapezoidal in shape, and is provided with a countersunk longitudinal groove containing upper portion 5*b* which is a parallelopiped elastic bar. Lower portion 5*a* forms an integral part of plate 7, which may be made of rigid plastic material, and which is connected to upper surface 1*a* of ski 1.

Figure 7:
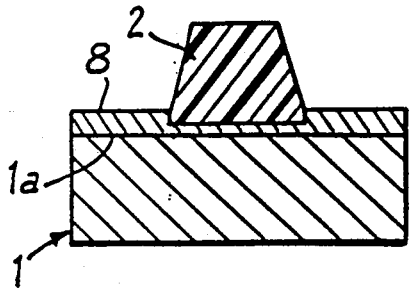

In the alternative embodiment of the invention shown in FIG. 7, guide rib 2 has a transverse cross-section in the form of an isosceles trapezoid. Rib 2 is made entirely of elastic material which is embedded, at its major base, in a countersunk groove in plate 8 of rigid material. Plate 8 is relatively thin and is attached to upper surface 1*a* of ski 1.

Figure 8:
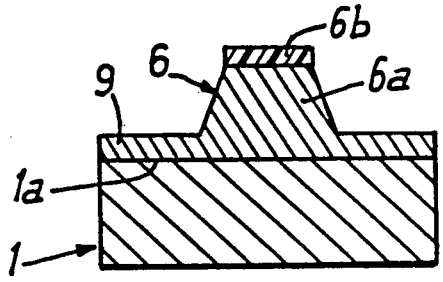

In the alternative embodiment of the invention shown in FIG. 8, the guide rib is similar to rib 6 of FIG. 5 and comprises lower portion 6*a* having a transverse cross-section in the form of an isosceles trapezoid which is integral with plate 9 connected to upper surface 1*a* of ski 1. Lower portion 6*a* in this embodiment is made of rigid material and carries, on its horizontal upper surface, a layer 6*d* of elastic material of the same width as that of the upper surface.

Figure 9:
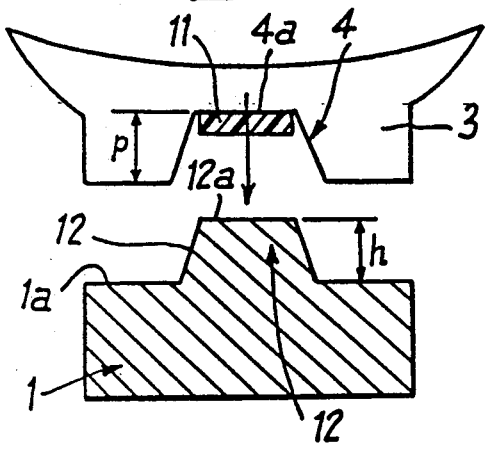
FIGS. 9 and 10 are transverse cross-sections of an alternative embodiment in which an elastic element is attached to the bottom of the sole of the shoe, showing before and after compression of the element as the shoe seats on the ski.
Figure 10:
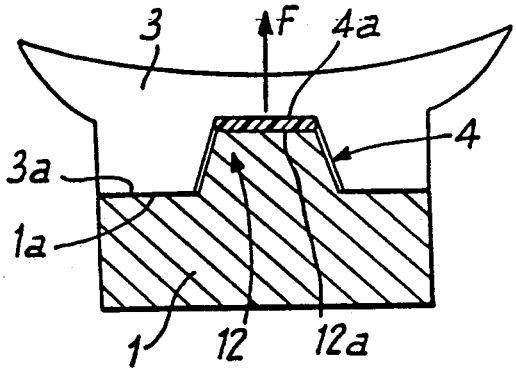

In the alternative embodiment of the invention shown in FIGS. 9 and 10, the elastic element is constituted by a layer 11 of elastic material of parallelopiped shape, positioned in the bottom of groove 4. Preferably, elastic material 11 is adhesively attached to bottom 4*a* of groove 4. Guide rib 12, made of rigid material, may be is integrally formed on ski 1 as shown in FIGS. 9 and 10. Alternatively, a thin plate carrying the guide rib may be applied to upper surface 1*a* of the ski. In this case, the height h of guide rib 12 is selected to be greater than the difference between depth p of groove 4 and thickness e of elastic element 11. As a result, when sole 3 is supported by its lower surface 3*a* on upper surface 1*a* of ski 1, elastic element 11 is compressed between bottom 4*a* of groove 4 in the shoe and upper surface 12*a* of longitudinal rib 12. Consequently, the compression of elastic element 12 exerts an upwardly directed force F on bottom 4*a* of groove 4. This force contributes to the upward rebound of the shoe after surface 3*a* of sole 3 has seated flat on the ski and thus assists in lifting movement of the foot of the wearer.

Figure 11:
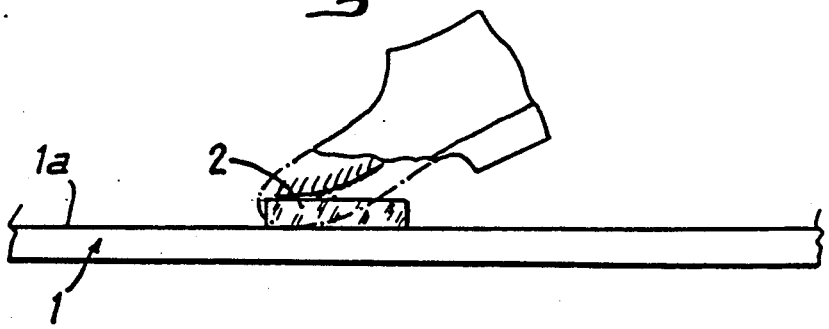
FIGS. 11 and 12 are side elevational views of a shoe mounted on a cross-country ski provided with an elastic longitudinal rib.
Figure 12:
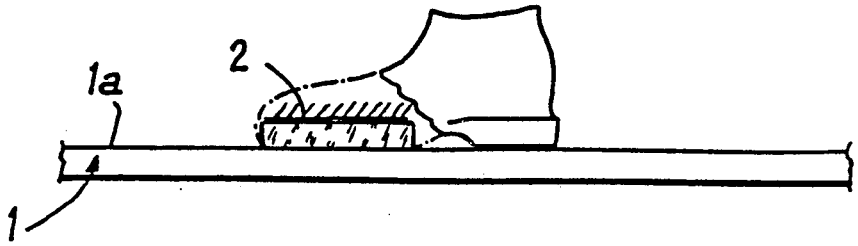

FIGS. 11 and 12 illustrate the action of the elastic guide ribs previously described. In FIG. 11, the heel of the shoe is shown lifted and inclined with respect to ski 1, and guide rib 2 is totally relaxed or unstressed because it is substantially free of contact with bottom 4*a* of groove 4 of sole 3 (FIG. 1). On the other hand, after the wearer has lowered his foot to the point where the sole is flat on the ski as shown in FIG. 12, sole 3 of the sole compresses guide rib 2, in the manner shown in FIGS. 3 and 10, because bottom 4*a* of groove 4 is engaged with the rib.

The elastic guide ribs extend principally over the entire plantar support zone of the shoe as shown in FIGS. 11 and 12. However, the rib may also extend over the entire length of the shoe. Furthermore, the transverse cross-section of the guide rib may have any shape, such as polygonal or curved, and may be symmetrical or dissymmetrical with respect to the longitudinal median plane of the ski. In addition, the height h may be constant or variable over the longitudinal length of the rib.

Although the invention has been described with reference to particular means, materials and embodiments, it is to be understood that the invention is not limited to the particulars disclosed, and extends to all equipment within the scope of the appended claims.

What is claimed is:

1. Apparatus for a cross-country ski-shoe whose toe is attached to the top surface of a cross-country ski for effecting displacement of the heel of the shoe relative to the ski, said shoe having a longitudinal groove in its sole at least in the front portion thereof, said groove being defined by a bottom and a pair of spaced, lateral guide faces, said apparatus comprising:

(a) a longitudinal guide rib adapted to be attached to the upper surface of the ski at a location where said groove receives said rib when the sole of the shoe seats flat on the ski;

(b) said rib including an elastic element that is engaged by the bottom of said groove in the shoe when the heel seats flat on the ski, and that is resiliently deformed thereby;

(c) said elastic element being constructed and arranged so that, in response to downward movement of the heel of the shoe into engagement with the ski, energy stored in the elastic element by reason of its resilient deformation is sufficient to create a force on the sole of the shoe that imparts an upward rebound to the heel of the shoe; and (d) wherein the longitudinal guide rib is formed in two portions, a relatively rigid lower portion, and an upper elastic portion embedded in a longitudinal groove in the upper surface of the lower portion, said elastic portion projecting above said upper surface so as to be elastically compressed by the bottom of the groove of the sole of the shoe when the heel seats flat on the ski, said rigid portion engaging and guiding the lateral guide faces of the groove in the sole of the shoe when the heel seats flat on the ski.

2. Apparatus according to claim 1 wherein said lower portion forms an integral part of the ski.

3. Apparatus according to claim 1 wherein said lower portion forms an integral part of a rigid plate applied to the upper surface of the ski.

4. Apparatus according to claim 1 wherein the height of the guide rib is greater than the depth of the groove in the sole of the shoe.

5. Apparatus according to claim 2 wherein the height of the guide rib is greater than the depth of the groove in the sole of the shoe.

6. Apparatus according to claim 3 wherein the height of the guide rib is greater than the depth of the groove in the sole of the shoe.

7. Apparatus for a cross-country ski having a longitudinal median plane for laterally guiding a ski shoe whose toe is attached to the ski, and whose heel is vertically movable in said plane on said ski, said apparatus comprising:

(a) a longitudinally extending guide rib adapted to be attached to the top of said ski symmetrically with respect to said median plane, and having top and lateral sides surfaces adapted to cooperate with a longitudinal groove in the sole of the ski shoe, said groove having a bottom and lateral side surfaces for receiving said rib when the sole of the shoe seats on top of the ski; and (b) resilient means interposed between the bottom of the groove in said shoe and the top of said ski for resilient compression in response to the seating of the sole on the top of the ski;

(c) said resilient means being constructed and arranged so that in response to its compression by the shoe caused by downward movement of the heel of the shoe into engagement with the ski, the resilient means imparts an upward rebound to the heel of the shoe;

(d) wherein said longitudinally extending guide rib constitutes said resilient means;

(e) wherein the top of said rib is a distance h from the top of the ski at a given longitudinal position thereon, and the groove in the sole has a depth p at the same longitudinal position, and wherein h is greater than p; and (f) wherein the cross-section of the rib at said given position is such that the lateral side surfaces of the rib deform into engagement with the lateral side surfaces of the groove in response to compression of the resilient means when the sole of the shoe seats on the top of the ski.

8. Apparatus according to claim 7 wherein the transverse cross-section of said rib has the shape of an isosceles trapezoid when said rib is in its unstressed state.

9. Apparatus according to claim 8 wherein said the transverse cross-section of said groove has the shape of an isosceles trapezoid.

10. Apparatus according to claim 8 wherein said apparatus includes a plate adapted to be attached to the top of the ski, and said rib is attached to said plate.

11. Apparatus according to claim 10 wherein said plate is provided with a continuous groove for receiving said rib.

12. Apparatus for a cross-country ski having a longitudinal median plane for laterally guiding a ski shoe whose toe is attached to the ski, and whose heel is vertically movable in said plane on said ski, said apparatus comprising:

(a) a longitudinal extending guide rib adapted to be attached to the top of said ski symmetrically with respect to said median plane, and having top and lateral sides surfaces adapted to cooperate with a longitudinal groove in the sole of the ski shoe, said groove having a bottom and lateral side surfaces for receiving said rib when the sole of the shoe seats on top of the ski; and (b) resilient means interposed between the bottom of the groove in said shoe and the top of said ski for resilient compression in response to the seating of the sole on the top of the ski;

(c) said resilient means being constructed and arranged so that in response to its compression by the shoe caused by downward movement of the heel of the shoe into engagement with the ski, the resilient means imparts an upward rebound to the heel of the shoe;

(d) wherein said resilient means is an element separate from but attached to said longitudinal guide rib which is substantially rigid;

(e) wherein the top of said element is a distance h from the top of the ski at a given longitudinal position thereon, and the groove has a depth p at the same longitudinal position, and wherein h is greater than p;

(f) wherein said element is attached to the top surface of said rib and projects therefrom; and (g) wherein, at a given longitudinal position on the ski, the transverse width of said element is less than the transverse width of the top surface of the rib.

13. Apparatus according to claim 12 wherein the top surface of the rib is longitudinally grooved to receive said element.

14. Apparatus according to claim 13 wherein said apparatus includes a plate adapted to be attached to the top of the ski, and said rib is attached to the plate.

15. Apparatus according to claim 14 wherein said plate is provided with a countersunk groove for receiving said rib.

* * * * *